US007384890B2

(12) United States Patent
Lubrino et al.

(10) Patent No.: US 7,384,890 B2
(45) Date of Patent: Jun. 10, 2008

(54) CHECK FRAUD PROTECTION TECHNIQUES

(75) Inventors: Enrico Lubrino, Staten Island, NY (US); Paul Gregory Piplani, West Caldwell, NJ (US); Patricia Mills, Lincoln Park, NJ (US)

(73) Assignee: ADP, Inc. (a Delaware XCorporation, Roseland, NJ (US)

( * ) Notice: Subject to any disclaimer, the term of this patent is extended or adjusted under 35 U.S.C. 154(b) by 442 days.

(21) Appl. No.: 11/027,657

(22) Filed: Dec. 30, 2004

(65) Prior Publication Data

US 2006/0145469 A1 Jul. 6, 2006

(51) Int. Cl.
*B41M 5/40* (2006.01)

(52) U.S. Cl. ..... 503/204; 283/94; 283/95; 283/114; 283/58; 428/916; 503/206

(58) Field of Classification Search ..... None
See application file for complete search history.

(56) References Cited

U.S. PATENT DOCUMENTS

| | | | | |
|---|---|---|---|---|
| 4,183,989 | A | 1/1980 | Tooth | |
| 5,193,854 | A | 3/1993 | Borowski, Jr. et al. | |
| 5,260,252 | A | 11/1993 | Frangie et al. | |
| 5,346,258 | A * | 9/1994 | Behm et al. | 283/102 |
| 5,433,807 | A | 7/1995 | Heckenkamp et al. | |
| 5,524,934 | A | 6/1996 | Schwan et al. | |
| 5,582,103 | A | 12/1996 | Tanaka et al. | |
| 5,636,874 | A | 6/1997 | Singer | |
| 5,681,065 | A * | 10/1997 | Rua et al. | 283/95 |
| 5,772,248 | A | 6/1998 | Phillips | |
| 5,781,654 | A | 7/1998 | Carney | |
| 5,890,141 | A | 3/1999 | Carney et al. | |
| 5,915,731 | A | 6/1999 | Jackson | |
| 6,036,233 | A | 3/2000 | Braun et al. | |
| 6,060,428 | A | 5/2000 | Chang et al. | |
| 6,073,121 | A | 6/2000 | Ramzy | |
| 6,089,614 | A * | 7/2000 | Howland et al. | 283/91 |
| 6,107,244 | A * | 8/2000 | Zeira et al. | 503/201 |
| 6,181,814 | B1 | 1/2001 | Carney | |
| 6,233,340 | B1 | 5/2001 | Sandru | |
| 6,369,919 | B1 | 4/2002 | Drinkwater et al. | |
| 6,390,362 | B1 | 5/2002 | Martin | |
| 6,521,036 | B1 | 2/2003 | Bleikolm et al. | |
| RE38,321 | E | 11/2003 | Uyama et al. | |
| 6,659,508 | B1 | 12/2003 | Nemeth et al. | |
| 6,665,406 | B1 | 12/2003 | Phillips | |

OTHER PUBLICATIONS

SICPA, Security Systems: OVI, website http://www.sicpa.com/731/730/5236/5238/5240/5242.asp, publication date unknown, visited Jul. 3, 2004, 2 pages.

* cited by examiner

*Primary Examiner*—Bruce H. Hess
(74) *Attorney, Agent, or Firm*—Ice Miller LLP; Homer W. Faucett, III; Doreen J. Gridley

(57) ABSTRACT

A security feature and method for verifying the authenticity of commercial paper. In one embodiment, pearlescent ink is added to a portion of commercial paper stock. A recipient can then tilt the commercial paper stock to view the pearlescent ink mark, design, or spot from different angles, causing the pearlescent ink to appear different colors and verifying the authenticity of the commercial paper. Further, according to another embodiment, thermochromic ink is applied to a portion of commercial paper stock. A recipient can then apply heat to the commercial paper stock in the area of the ink mark, thereby causing the thermochromic ink to disappear or change colors.

11 Claims, 4 Drawing Sheets

CHECK FRAUD PROTECTION TECHNIQUES

BACKGROUND

This invention relates to authentication of commercial paper, and, in particular, to techniques used on commercial paper to resist fraud.

Validation of commercial paper, such as checks, presents a significant challenge for financial institutions. With the availability of reproduction technology, such as color scanners and color copiers, criminals are provided with inexpensive ways to produce counterfeit checks and false identification that can be used to defraud financial institutions, such as banks, thrifts, savings banks, credit unions, and check cashing institutions.

To combat fraud, various techniques have been developed. For example, checks often contain information about the account and the value of the paper, and special patterns and designations are applied to the check to discourage replication. Many of these older techniques are deficient in view of today's replicating technology, such as color copiers, scanners, and printers.

Some systems developed to combat check fraud require investment inspired equipment for the payor and the financial institution. Consider, for example, the system of U.S. Pat. No. 5,781,654 that uses a computer to convert the payee information, issue date, and MICR information to a check digit placed onto the check, and another computer at the bank to convert the printed payee information and issue date to compare the information to see whether the check has been altered. U.S. Pat. No. 6,073,121 discloses a system that prints encrypted machine only readable symbols on the check, and a special reader at the bank for reading the encrypted data. U.S. Pat. No. 6,390,362 likewise prints special codes (a bar code) on a check and requires a scanner at the financial institution to read the bar code. Such investment inspired equipment can be cost prohibitive to small payors and small independent financial institutions.

Another known system used to combat fraud is to mark the commercial paper with a controlled ink having the property of completely changing its color when viewed from the different angles. In particular, the controlled ink used is a proprietary optically variable pigment described in U.S. Pat. No. 6,521,036 to Bleikolm et al., incorporated herein by reference, and is distributed for use only in banknote and high-security federal document printing applications. However, optically variable pigment is highly controlled and cost prohibitive for use in ordinary commercial paper applications.

Some other security features are added directly to the checks. These security features include watermarks, copy void pantographs (when photocopied, the word "VOID" appears), chemical voids (chemical treatment of the check stock activated by eradicator chemicals to make the word "VOID" appear), high resolution microprinting, and three-dimensional reflective hollow stripes are just some of the examples used. Some of these techniques are expensive, others are not effective in view of today's replicating technology, and still others require an institution to handle chemicals for validation.

It is desired to provide commercial paper fraud protection techniques that do not require special equipment or chemicals to read or validate the commercial paper. It is also desired to provide techniques that can be used with existing check stock and that is readily available and relatively inexpensive to producers of commercial paper while remaining difficult to obtain by counterfeiters. It is further desired to provide fraud protection that prevent duplication, deters replication, and provides multiple, performing features that are easy to validate.

SUMMARY

According to one aspect of the present invention, a fraud resistant commercial paper stock has an ink mark, design or spot wherein the ink has the property of reflecting different colors depending upon the angle from which it is viewed. Additionally, the ink mark on the commercial paper stock may comprise a shield.

Yet another aspect of the present invention is a fraud resistant commercial paper stock having an ink mark, design, or spot comprising a pearlescent ink.

Further, another aspect of the present invention refers to a fraud resistant commercial paper stock having an ink mark, design, or spot wherein the ink comprises thermochromic ink. Additionally, the commercial paper stock may include instructions referring to testing the ink mark, design, or spot.

Another aspect of the present invention involves a method for verifying the authenticity of commercial paper, the method comprising the steps of providing a commercial paper stock having an ink mark comprising a pearlescent ink, distributing the commercial paper stock; and viewing the commercial paper stock at more than one angle to verify the pearlescent property of the mark.

DESCRIPTION

Figure 1A:
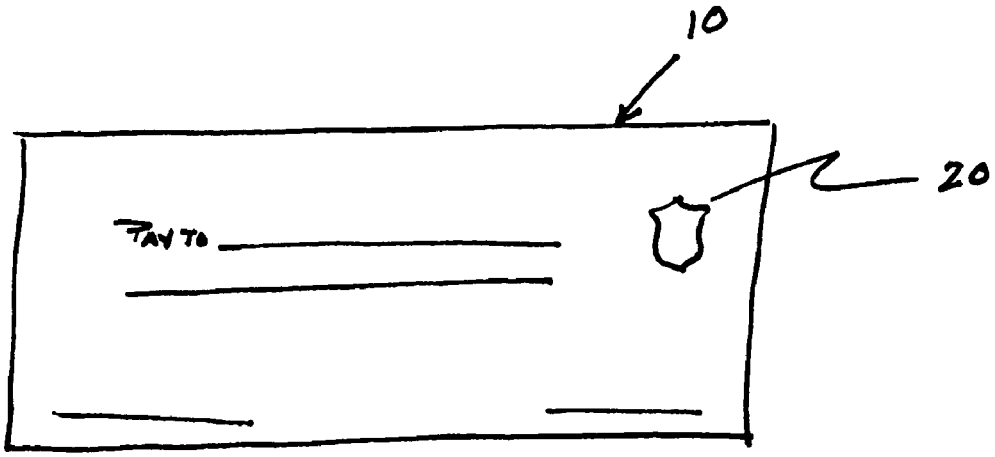
FIG. 1A shows a top plan view of commercial paper stock according to one aspect of the present invention.
Figure 1B:
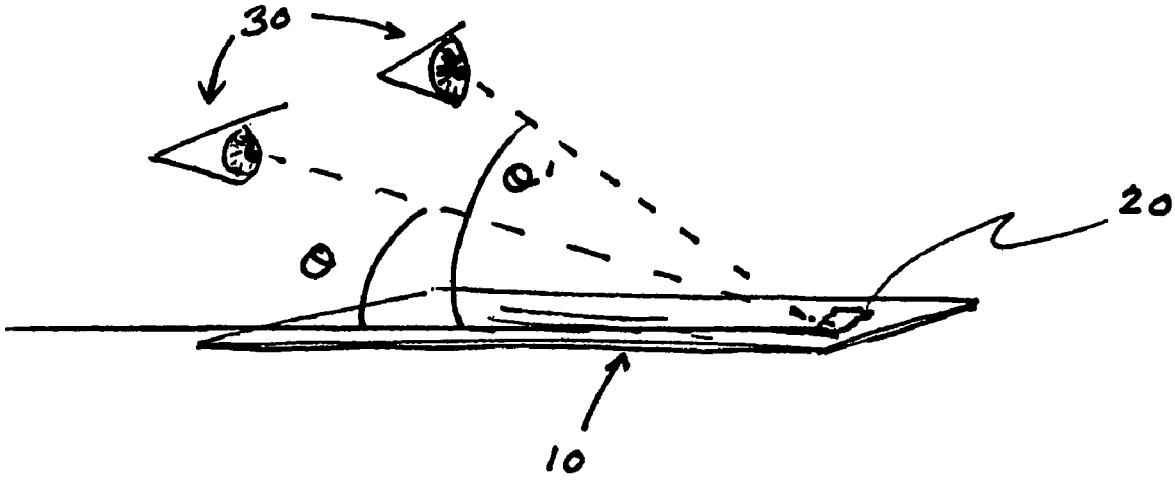
FIG. 1B shows a perspective view of a commercial paper stock according to one aspect of the present invention.

Referring now to FIGS. 1A and 1B, a fraud-resistant commercial paper stock according to one aspect of the present invention, a mark comprising pearlescent ink that changes tone as the angle of the reflected light changes. According to this aspect of the present invention, a mark such as a spot or design comprising a pearlescent ink mark 20 is placed upon a commercial paper stock 10 in a predetermined area (illustratively in the upper center of the front of the commercial paper stock in FIG. 1A) of a check, commercial paper, or other negotiable instrument ("commercial paper" or "commercial instrument"). The pearlescent ink used may be that supplied by SICPA North America, Inc. of Brooklyn Park, Minn. and is a pearlescent ink derived from a class of inorganic pigments known as metallic solids. Pearlescent ink, as described herein, describes a two part ink having a semi-transparent ink portion in which a pigment may be used to tint to the desired color, and a second metallic portion that is suspended within the semitransparent ink. In application, the pearlescent ink mark 20 may be applied to a predetermined area of the commercial paper using a flexographic printing processes, or by other printing processes known in the art. Therefore, when the pearlescent ink mark 20 is affixed to commercial paper stock 10, recipients can verify the authenticity of the check by examining the pearlescent ink mark 20 according to the process outlined below. Use of the pearlescent ink is contemplated, not only because its peculiar physical property to vary its perceived tone based upon its angle of view, but also because it is readily available to producers of commercial paper but prohibitive for use by counterfeiters because of the cost of the machinery required for the flexographic printing process typically employed in applying the pearlescent ink.

As shown in FIG. 1B, if the commercial paper stock is authentic, changing the angle of the check will alter the perceived tone of the pearlescent ink mark 20 much like the color change that occurs when mother of pearl is viewed at varying angles. For example, when commercial paper stock 10 is held a an angle θ to viewer 30, the pearlescent ink mark 20 tone may appear a blue color (or illustratively, any other color), while changing the angle of the commercial paper stock 10 to viewer 30 to an angle θ' results in the mark appearing metallic green (or, illustratively, another color that changes tone upon changing viewer angle). This effective change in tone is a property of the semi-transparent ink portion, as light is reflected from the surface of the semi-transparent ink at angle θ, reflecting the color of the colorant used in the semitransparent ink. However, at angle θ', light passes through the semi-transparent ink, reflecting from the metallic portion, and giving the appearance of the color of the metallic portion. At those angles between angle θ and angle θ', various shades of the two tones represented by the semi-transparent ink and metallic portion. Therefore, simply by examining pearlescent ink mark 20 at varying angles, a recipient can test the present security feature to aid in determining the authenticity of the commercial instrument. While pearlescent ink mark 20 changes tone, it should be noted that it does not change color like the OVI® ink that is controlled and only distributed for use in secure bank and government documents. Rather, the composition of the pearlescent ink is substantially different, as is the process in its affixation to commercial paper stock 10, resulting in a fraud protection technique that is substantially more cost effective.

Figure 2A:
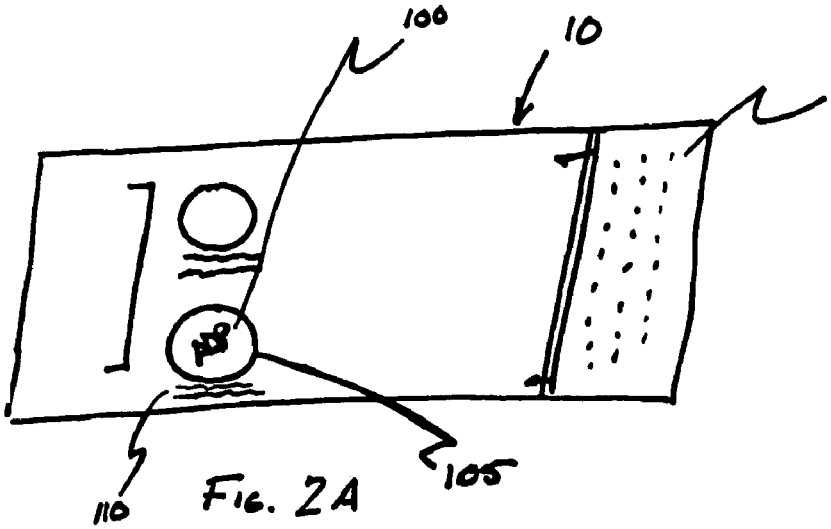
FIG. 2A shows a top plan view of commercial paper stock according to an aspect of the present invention.

Turning now to FIGS. 2A, 2B, 2C, and 2D, a fraud-resistant check security feature according to another aspect of the present invention, a thermochromic pigment is applied to commercial paper stock. Thermochromic pigment is characterized as changing color or otherwise varying its appearance in response to the application of heat or warmth. Thermochromic pigment may comprise liquid crystal pigments, leucodytes, or other known temperature-sensitive inks. As shown in FIG. 2A, thermochromic pigment is illustratively used to print a thermochromic mark 100 (for exemplary purposes, an "ADP" logo is utilized here) on a predetermined area of commercial paper 10. Thermochromic mark 100 may take the form of a spot, design, alphanumeric, or other identifier as preferred by one practicing this aspect of the present invention. In the example displayed in FIG. 2A, thermochromic mark 100 is applied to the back of a commercial instrument, and placed inside a circled area 105 to draw attention to thermochromic mark 100. Additionally, instructions 110 regarding testing of thermochromic mark 100 may be offered. For example, instructions may read "Design printed with ink that responds to warmth. Hold between thumb and forefinger or breathe on it—the design will fade and reappear."

Figure 2B:
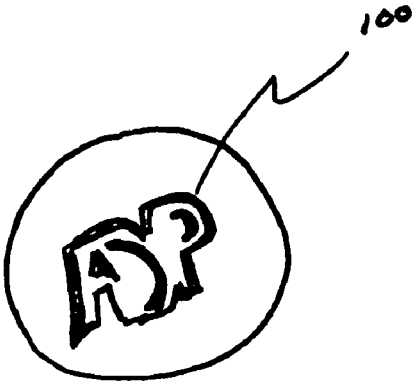
FIG. 2B shows a detail of a fraud prevention feature according to an aspect of the present invention.
Figure 2C:
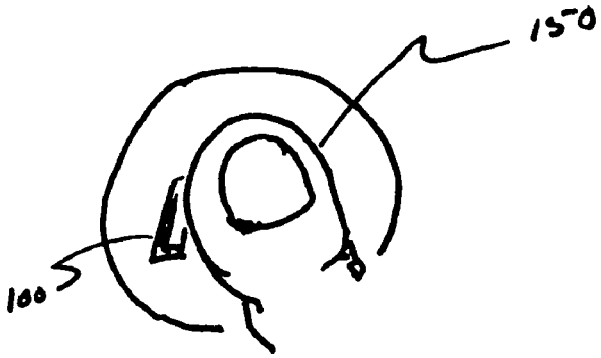
FIG. 2C shows a detail of a fraud prevention feature according to an aspect of the present invention.
Figure 2D:
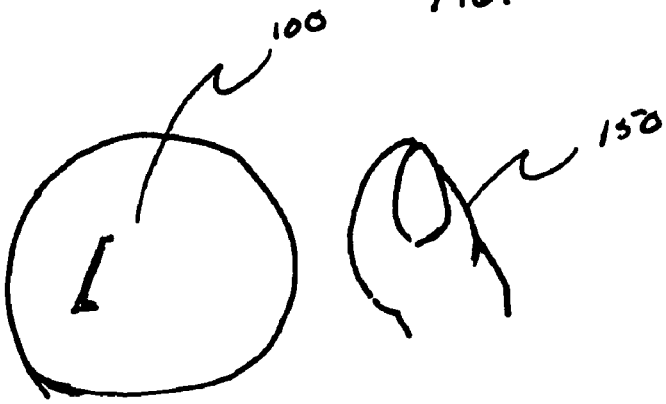
FIG. 2D shows a detail of a fraud prevention feature according to an aspect of the present invention.

In application, thermochromic mark 100 changes color or appearance when exposed to heat or warmth, indicating to a recipient that the commercial paper is genuine. For example, a recipient may follow the written instructions below thermochromic mark 100 by applying a thumb and forefinger to thermochromic mark 100 as depicted in FIG. 2C. As shown in FIG. 2B, thermochromic mark 100 "ADP" is visible when the commercial paper is at room temperature, but once the commercial paper is heated in the area of thermochromic ink 100 mark by the application of an individual's thumb 150, the "ADP" mark printed in thermochromic ink 100 disappears in the area where heat (thumb 150) is applied (see FIG. 2D). However, when the commercial paper stock 10 returns to room temperature, the design reappears as shown in FIG. 2B.

Figure 3A:
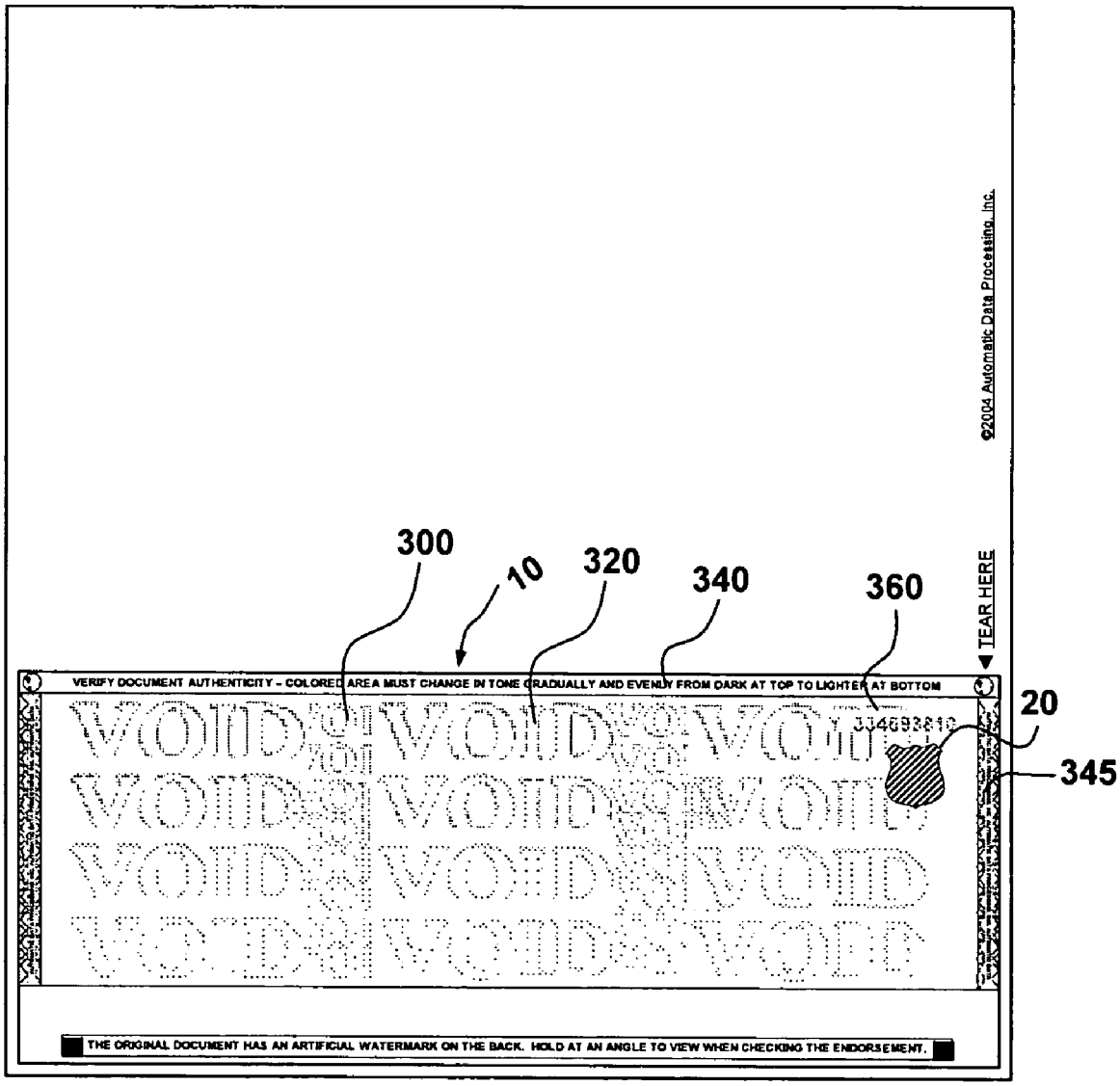
FIG. 3A shows a plan view of the front of a commercial paper stock according to one aspect of the present invention.
Figure 3B:
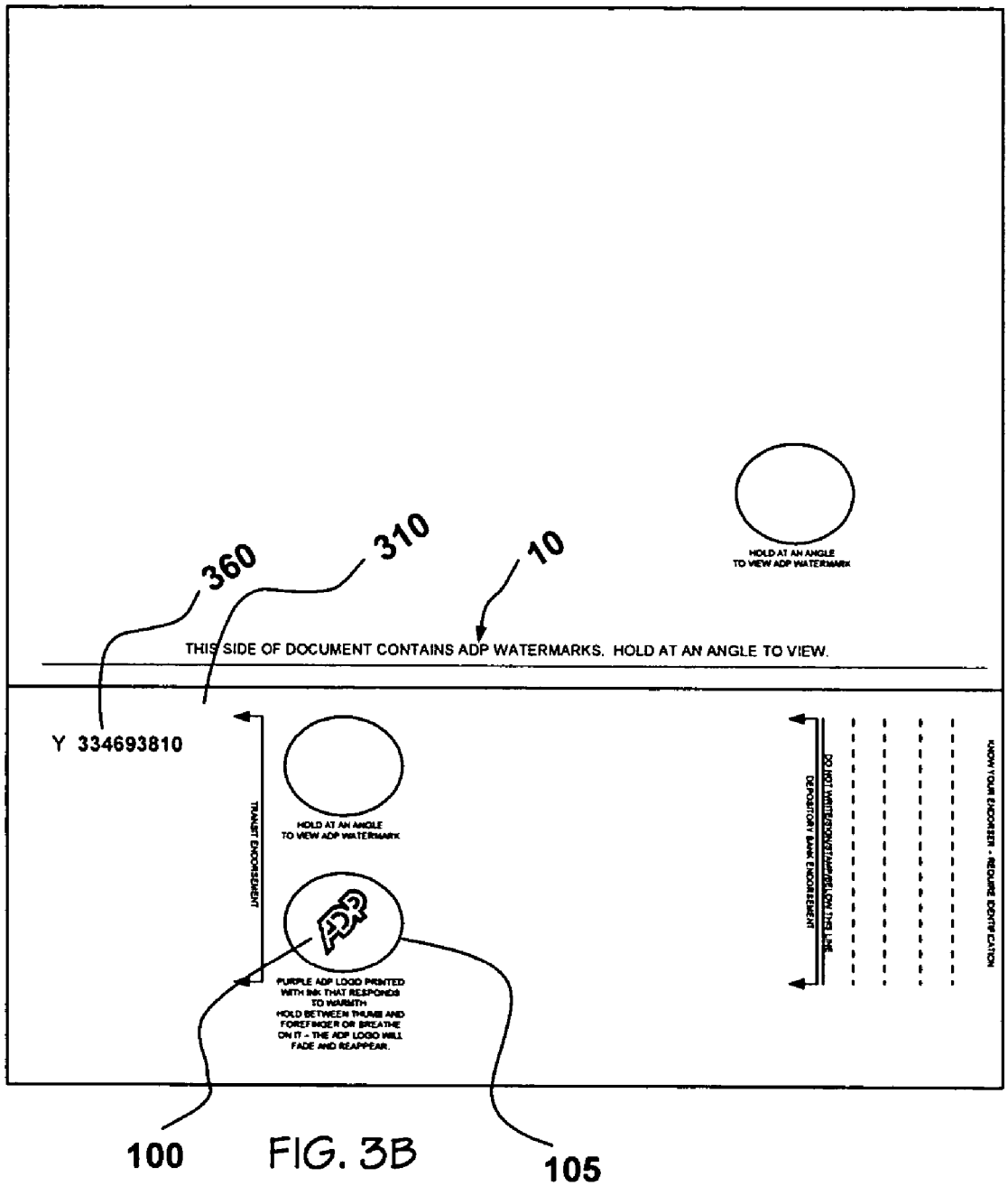
FIG. 3B shows a plan view of the back of a commercial paper stock according to one aspect of the present invention.

Additionally, the embodiments described above may be used in conjunction with one another to further enhance the security of a commercial instrument. For example, as shown in FIGS. 3A and 3B, an exemplary illustration of a front and back side (respectively) of a commercial paper stock 10, commercial paper stock 10 may contain both a pearlescent ink mark 20, and a thermochromic mark 100. Illustratively, in FIG. 3A, pearlescent mark 20 (illustratively in the form of a shield) is used in a designated area on the front 300 of commercial paper 10. Further, referring to FIG. 3B, thermochromic ink 100 may be used on the back 310 of commercial paper 10. Using these security features in conjunction with one another allows a recipient to verify the authenticity of the commercial instrument by checking both the pearlescent mark 20 and thermochromic mark 100, thereby allowing verification without the use of a machine or other device.

The abovementioned embodiments may be used with other security features such as prismatic print or simulated prismatic print with a step and repeat background design. Simulated prismatic print with a step and repeat feature is not shown, as the print is not readily photocopied, and is often used in two colors with one color evenly fading into another at two places on commercial paper stock (not shown). More descriptively, a simulated prismatic print with a step repeat design illustratively utilizes two colors of ink that fade into one another through the careful placement of small ink dots of differing colors. For example, the background of the left front of a commercial paper stock may appear blue, fading into red in the center, and then back into blue on the right side. This may be accomplished through simulated prismatic print processes well known in the art where two different colors of ink are separately used to print different areas of the check in a manner that causes the appearance of the two colors gradually melding at the point where they meet. Alternatively, this effect may be accomplished through true prismatic printing processes well known in the art, wherein the color melding effect is caused by the actual mixture of the two colors of ink prior to printing so that the transition from one color (for example blue) to a second color (for example red) is created by the graduated mixture of the red and blue inks along the melding area to create a gradual transition from one color to the next. The gradual transition between the two colors, and any design that is created thereby is difficult to reproduce, making counterfeiting of the commercial paper stock difficult.

Another security feature that may be used in association with the above embodiments is a pantograph 320 that is readily viewed when the commercial paper is copied, but not easily seen in the original. For example, as shown in FIG. 3A, when copied, the term "VOID" is seen repeatedly on the front of a photocopied commercial paper stock, but the pantograph is not readily seen in the original.

Additionally, microprint in high resolution may be used in multiple locations on a commercial paper stock to add a further safety feature. Microprint is readily viewed only through the use of magnification, and cannot be reproduced in high quality using printers readily available to the general public, increasing the difficulty for counterfeiters to reproduce the feature and adding security to the commercial paper stock. Microprint may be used to print identifying information in areas where it is not visible to the naked eye. For example, FIG. 3A contains the letters "ADP" printed repeatedly along the bottom of top border 340, and, in larger print, has the letters "AUTOMATIC DATA PROCESSING" written along the middle of side border 345. Neither print is readily visible to the naked eye, and when magnified, it is apparent that it is not reproduced with well-defined edges due to the conventional copier used to create FIG. 3A.

Another security feature that may be used in conjunction with the abovementioned security features is ink comprising two components that can bleed through the commercial paper stock causing a bleed-through mark 360 visible on both sides (sometimes in different colors on each side). As can be seen in FIG. 3A and FIG. 3B, when bleed-through mark 360 is applied to one side of commercial paper stock, a near mirror-image of the mark appears on the opposite side of the commercial paper stock. The formulation of the ink such that reproduction of bleed-through mark 360 is difficult to counterfeit. Additionally, watermarks may be used as a security feature, making the watermark visible when the commercial paper is held at an angle or up to light but not readily perceived when the paper is viewed head-on (not shown). Watermarks are well-known in the art, and are difficult to reproduce using scanners or copies, adding security to the commercial paper stock. Additionally, an artificial watermark may be used as a security feature. A artificial watermark is not a true watermark, but an ink mark applied to plain paper that appears to be a true watermark, as accomplished by printing on paper with fatty materials or by any other method known in the art. Finally, simulated embossed print may be used in addition to the other security features. Simulated embossed print is print that forms an image which appears as if it has been made by stamping and creasing the commercial paper stock, although no such stamping or creasing has occurred (not shown).

By utilizing a commercial paper stock containing multiple security features as those discussed above, replication and counterfeiting is made more difficult for a counterfeiter than if a counterfeiter was simply attempting to replicate each of the security features individually. Therefore, according to one aspect of the present invention, a commercial paper stock comprises a thermochromic mark 100, a pearlescent ink mark 20, a true or simulated prismatic print with a step and repeat design, a void pantograph, high resolution microprint, a bleed-through mark 360, an artificial watermark, and a simulated embossed print. Inclusion of each of these features on a single commercial paper stock significantly precludes a counterfeiter from replicating the commercial paper stock, giving security to the recipient of a commercial instrument executed on that stock.

Although the present invention has been described in considerable detail with reference to certain preferred versions thereof, other versions are possible. Therefore, the spirit and scope of the appended claims should not be limited to the description of the preferred versions contained herein.

What is claimed is:

1. A fraud resistant commercial paper stock comprising:

a. a first ink mark comprising a pearlescent ink;

b. a second ink mark comprising a thermochromic ink;

c. at least one letter or group of characters printed in microprint along at least one border of the commercial paper stock;

d. at least one mark comprising an ink comprising two components, operable to be printed on one side and bleed through to a second side;

e. at least one character in simulated embossed print; and f. at least one character created in pantograph.

2. The fraud resistant commercial paper stock of claim 1, wherein the first ink mark further comprises the shape of a shield.

3. The fraud resistant commercial paper stock of claim 2, wherein the second ink mark further comprises the characters "ADP."

4. The fraud resistant commercial paper stock of claim 3, wherein the at least one letter or group of letters printed in microprint along at least one border of the commercial paper stock further comprises the repeated characters "ADP."

5. The fraud resistant commercial paper stock of claim 4, wherein the at least one character created in pantograph comprises the word "void."

6. The fraud resistant commercial paper stock of claim 4, further comprising at least one artificial watermark operable to be readily viewed only when the commercial paper stock is held at an angle not equal to ninety degrees to the viewer.

7. The fraud resistant commercial paper stock of claim 1, further comprising a third ink mark comprising a thermochromic ink, the third ink mark placed on an opposite side of the commercial paper from the second ink mark.

8. The fraud resistant commercial paper stock of claim 1, wherein the second ink mark comprises the letters ADP.

9. The fraud resistant commercial paper stock of claim 1, wherein the second ink mark comprises the shape of a padlock.

10. The fraud resistant commercial paper stock of claim 1, further comprising a prismatic print.

11. The fraud resistant commercial paper stock of claim 1, further comprising a simulated prismatic print.

* * * * *